US011851994B2

(12) United States Patent
Santin et al.

(10) Patent No.: US 11,851,994 B2
(45) Date of Patent: Dec. 26, 2023

(54) COILED TUBING GRAVITY FEED UNDER LIVE WELL CONDITIONS

(71) Applicant: Halliburton Energy Services, Inc., Houston, TX (US)

(72) Inventors: Yoann Santin, London (GB); Alexandra Charlie Tramier, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/497,662

(22) Filed: Oct. 8, 2021

(65) Prior Publication Data

US 2023/0109806 A1 Apr. 13, 2023

(51) Int. Cl.
*E21B 43/12* (2006.01)
*E21B 33/038* (2006.01)
*E21B 34/06* (2006.01)

(52) U.S. Cl.
CPC ..... *E21B 43/12* (2013.01); *E21B 33/038* (2013.01); *E21B 34/06* (2013.01)

(58) Field of Classification Search
CPC ..... E21B 43/12; E21B 33/038; E21B 34/06
USPC ..... 166/305.1
See application file for complete search history.

(56) References Cited

U.S. PATENT DOCUMENTS 6,273,189 B1 * 8/2001 Gissler ..... E21B 4/04 166/241.1
8,439,109 B2 * 5/2013 Sbordone ..... E21B 47/04 175/45
8,720,582 B2 * 5/2014 Portman ..... E21B 19/22 166/344
9,822,613 B2 * 11/2017 Crawford ..... E21B 33/076
2004/0094305 A1 * 5/2004 Skjærseth et al. .... E21B 19/146 166/70

(Continued)

FOREIGN PATENT DOCUMENTS

EP 2220337 5/2012
WO 2011-127411 10/2011

OTHER PUBLICATIONS

International Search Report and Written Opinion for Application No. PCT/US2021/055857, dated Jun. 29, 2022.

*Primary Examiner* — Matthew R Buck
*Assistant Examiner* — Patrick F Lambe
(74) *Attorney, Agent, or Firm* — Thomas Rooney; C. Tumey Law Group PLLC

(57) ABSTRACT

The present disclosure relates to gravity feeding coiled tubing (CT) into a live well. A method may include gravity feeding the CT into the live well having a wellhead, a line in fluid communication with the wellhead, a CT stripper and pressure control equipment (PCE) disposed above the wellhead, and a safety valve disposed below the wellhead, the method comprising: injecting a fluid through the line and into the wellbore to displace reservoir fluid positioned above the safety valve such that at least a portion of the reservoir fluid is forced below the safety valve; closing the safety valve; releasing pressure from between the PCE and the safety valve via the line; gravity feeding the CT into the wellbore; isolating pressure between the PCE and the safety valve; manipulating pressures on both sides of the safety valve; opening the safety valve; and gravity feeding the CT past the safety valve.

18 Claims, 10 Drawing Sheets

(56) References Cited

U.S. PATENT DOCUMENTS

| | | | | |
|---|---|---|---|---|
| 2006/0124314 | A1 | 6/2006 | Haheim et al. | |
| 2008/0230228 | A1* | 9/2008 | Askeland | E21B 33/076 166/352 |

* cited by examiner

COILED TUBING GRAVITY FEED UNDER LIVE WELL CONDITIONS

BACKGROUND

During interventions of wells with low wellhead pressure such as dead wells, coiled tubing (CT) may be run into the well via gravity feeding. During gravity feeding, the CT is lowered into the wellbore due to the force of gravity which pulls the CT into the wellbore. However, for live wells, the wellhead pressure may force the CT upward due to configurations of subsea equipment. For example, a length of a lubricator section below a subsea stripper may be limited, thus, the weight of the CT may not be sufficient to overcome the upward force and allow the CT to be gravity fed into the well.

BRIEF DESCRIPTION OF THE DRAWINGS

These drawings illustrate certain aspects of some examples of the present invention and should not be used to limit or define the invention.

DETAILED DESCRIPTION

Systems and methods of the present disclosure generally relate to well interventions and, more particularly, may relate to CT gravity feed techniques for live wells. The gravity feed techniques as described herein may be implemented with existing well completion design rather than adding costly equipment to a bottom hole assembly (BHA). For example, subsea wells may include a safety valve in the tubing that may be manipulated (e.g., opened and closed) on demand. The safety valve may include a tubing-retrievable safety valve (TRSV), or a non-retrievable safety valve. Also, a section of tubing between the safety valve and pressure control equipment (PCE) may be used as a lubricator. It should be noted that that when the safety valve is not in the well or not operational, a retrofit safety valve may be installed.

In particular examples, the PCE and a CT stripper (e.g., the subsea stripper) may be installed on top of a subsea wellhead via a remotely operated vehicle (ROV). A kill/return line may be connected to the subsea wellhead, and fluid may be injected into the well to replace/displace any fluid/hydrocarbons between the safety valve and the subsea wellhead.

Then, the safety valve may be closed, and pressure between the PCE and the safety valve may be bled through the kill/return line. Next, the coiled tubing (CT) may be run into the well via gravity feed, until the safety valve is reached. Then, the CT stripper may close, and the fluid may be pumped via the CT to pressurize the section of tubing between the CT stripper and the safety valve. In some examples, a reduction in a pressure differential across the safety valve may occur to allow gravity feeding of the CT. For example, the pressures on both sides of the safety valve may be equalized, substantially equalized, or urged to equilibrium. In some examples, the CT stripper may be closed before opening and passing the CT through the wellhead.

Then, the safety valve may open, and the CT may be run further downhole from the safety valve via gravity feeding. In some examples, when pulling the CT out of the well, the safety valve may also be utilized as a lubricator. A downhole direction may refer to a direction that extends deeper into a wellbore; whereas, an up-hole direction may extend in the opposite direction that extends to the surface of the wellbore.

Figure 1:
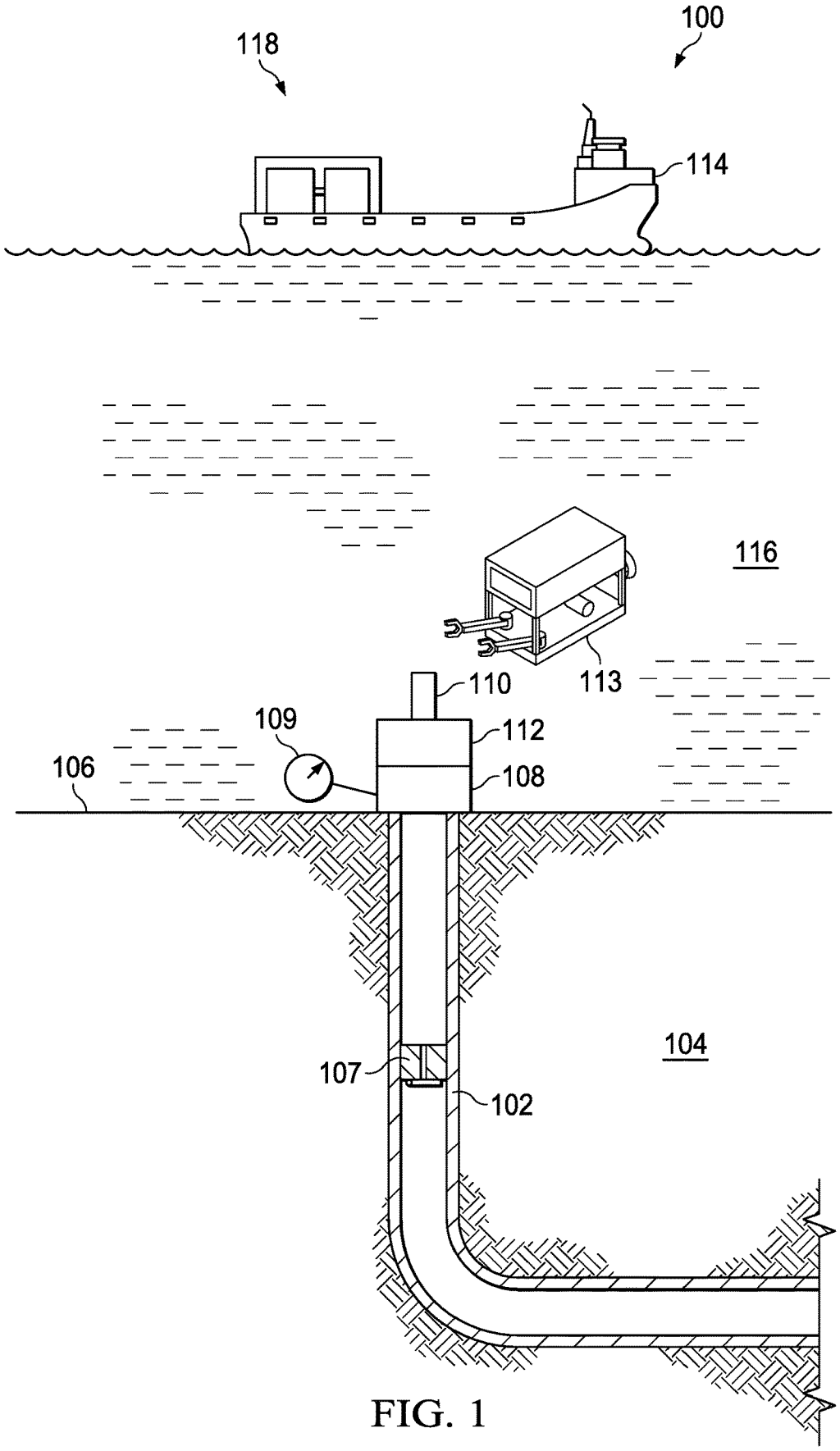
FIG. 1 illustrates a system for gravity feeding CT into a wellbore during a first stage, in accordance with examples of the present disclosure.

FIG. 1 illustrates a system 100 for gravity feeding CT into a wellbore 102 during a first stage, in accordance with examples of the present disclosure. Although an offshore/subsea environment is illustrated, the techniques as described herein may also be employed in land-based operations.

In some examples, the wellbore 102 may include a live well. The live well may include wellhead pressures ranging up to 15,000 psi. The wellbore 102 may extend into a subterranean formation 104 beneath a sea floor 106. The wellbore 102 may include cased and/or open-hole section(s) or any type of completion. A safety valve 107 (e.g., TRSV or non-retrievable safety valve) may be disposed in the wellbore 102. As illustrated, the safety valve 107 is open or may be opened if closed.

A wellhead 108 may be disposed adjacent to the sea floor 106 and may be connected to the top of the wellbore 102. The wellhead pressure may be indicated by a pressure gauge 109. As illustrated, the pressure is sufficient to prevent gravity feeding of CT into the wellbore.

During the first stage of the gravity feed operation, a CT stripper 110 and PCE 112 may be disposed above the wellhead 108. The CT stripper 110 may provide a seal around the CT to maintain pressure below the CT stripper 110. For example, the CT stripper 110 may seal (e.g., stripper rubber) around the CT as the CT is stripped in and out of the wellbore 102.

The PCE 112 may include blow-out preventers (BOP) and a lubricator section, for example. The CT stripper 110 and the PCE 112 may be installed on the seafloor 106 via a remotely operated vehicle (ROV 113) that may be deployed from intervention vessel 114. The CT stripper 110 may be initially open and the BOP may provide fluid/pressure isolation.

The intervention vessel 114 may include an offshore structure such as, for example, a ship, rig, barge, or platform. The intervention vessel 114 may be disposed in a body of water 116 above the wellbore 102. The intervention vessel 114 may include a gravity feed kit 118. The gravity feed kit 118 may include at least CT, a pump, reel(s) for moving/storing the CT and/or other conduits, a cantilever or deployment skid frame with injectors, goosenecks and clump weights to deploy CT and/or other conduits into the water, powerpacks, a data acquisition system or control cabin, a fluid source (e.g., a tank), and conduit(s), such as a downline, for example. In some examples, the gravity feed kit 118 may also include any other equipment required to perform the intervention scope, additional fluid source, pumps, batch mixers, nitrogen tanks, nitrogen converters, nitrogen pumping equipment, additional conduits, for example.

Figure 2:
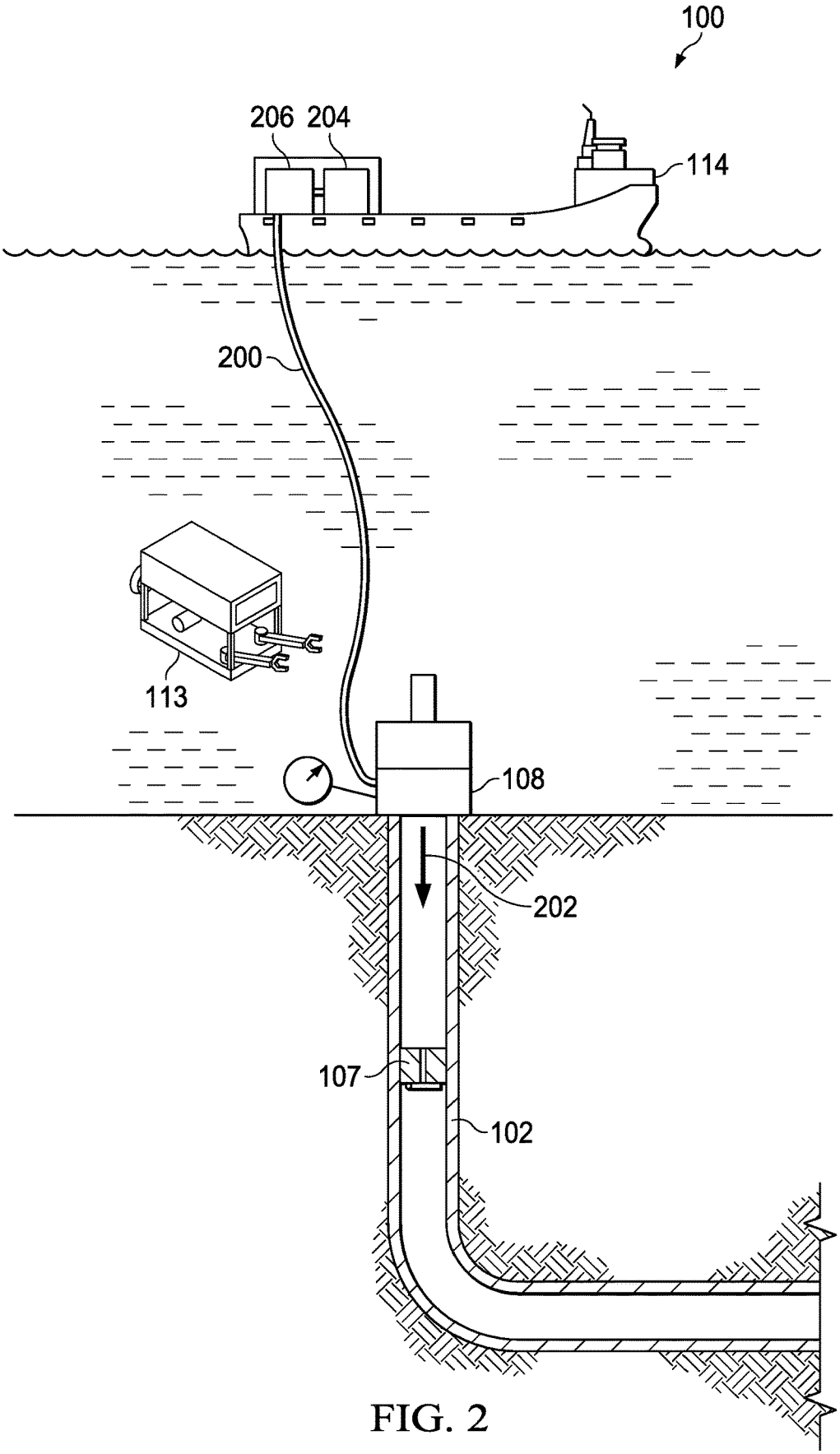
FIG. 2 illustrates the system for gravity feeding the CT during a second stage, in accordance with particular examples of the present disclosure.

FIG. 2 illustrates the system 100 for gravity feeding CT into the wellbore 102 during a second stage, in accordance with examples of the present disclosure. A downline 200 (e.g., kill/return line) extending from the intervention vessel 114 may be connected (e.g., via the ROV 113) to the wellhead 108, and fluid 202 may be injected into the wellbore 102 via the downline 200 to replace/displace any fluid/hydrocarbons between the safety valve 107 and the wellhead 108. In some examples, the downline 200 may include a flexible hose or rigid pipe (e.g., CT). The downline 200 may connect to a kill/flow line or any subsea connection.

The fluid 202 may be moved into the wellbore 102 from a fluid source 204 via a pump 206. Non-limiting examples of the fluid 202 may include brine, water, or gas (e.g., nitrogen). Injection of the fluid may cease when a sufficient amount of fluid is injected to force a volume of reservoir fluid(s) out of the section between the safety valve 107 and the wellhead 108. For example, a total volume of the reservoir fluid may be urged downhole below the safety valve 107. In some examples, it may be desired to displace all or substantially all of the reservoir fluid downhole below the safety valve 107.

Figure 3:
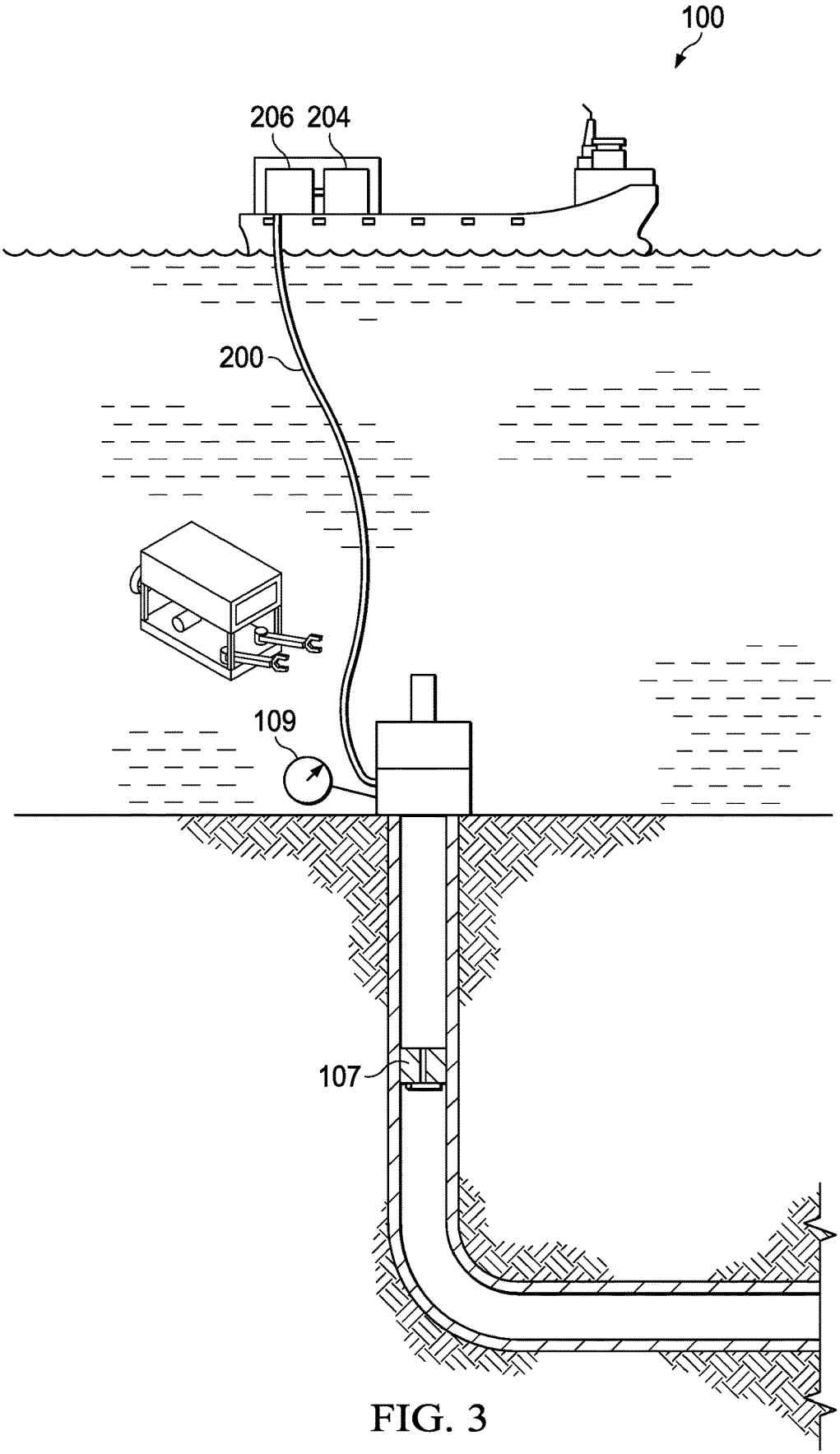
FIG. 3 illustrates the system for gravity feeding the CT during a third stage, in accordance with particular examples of the present disclosure.

FIG. 3 illustrates the system 100 for gravity feeding CT into the wellbore 102 during a third stage, in accordance with examples of the present disclosure. The safety valve 107 may be closed by hydraulic (or electric) means such as in TRSVs. The wellhead pressure may remain at a sufficient level to prevent gravity feeding of CT, as indicated by the pressure gauge 109.

Figure 4:
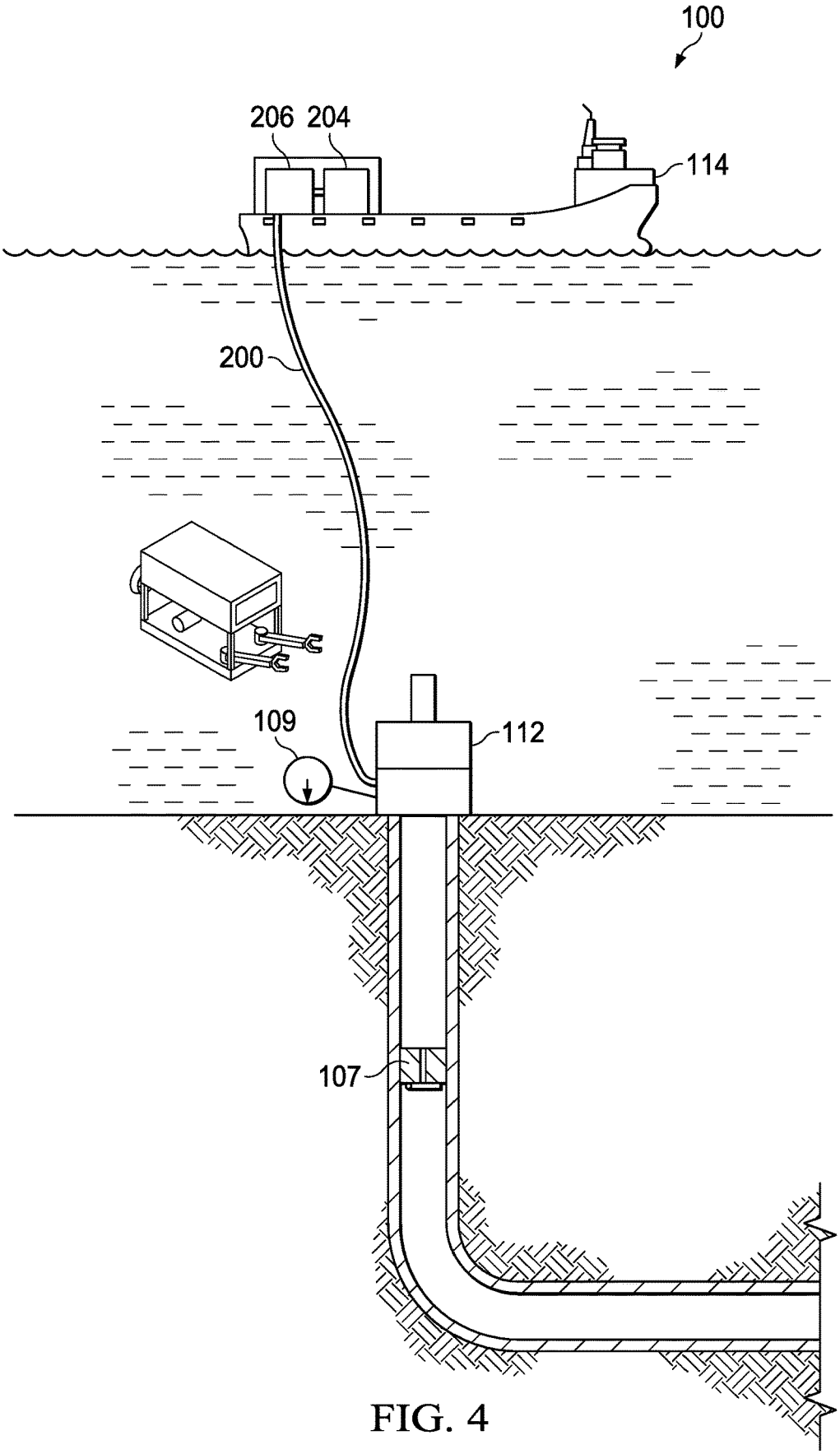
FIG. 4 illustrates the system for gravity feeding the CT during a fourth stage, in accordance with particular examples of the present disclosure.

FIG. 4 illustrates the system 100 for gravity feeding CT into the wellbore 102 during a fourth stage, in accordance with examples of the present disclosure. The pressure between the PCE 112 and the safety valve 107 may be bled. For example, the pressure may be bled through the downline 200 (e.g., kill/return line) back to the intervention vessel 114 or another location, or bled through subsea installation, until the wellhead pressure is reduced to a pressure that is less than the force required for a bottom hole assembly (BHA) to enter the well by gravity. The reduction of the wellhead pressure is indicated by the pressure gauge 109.

Figure 5:
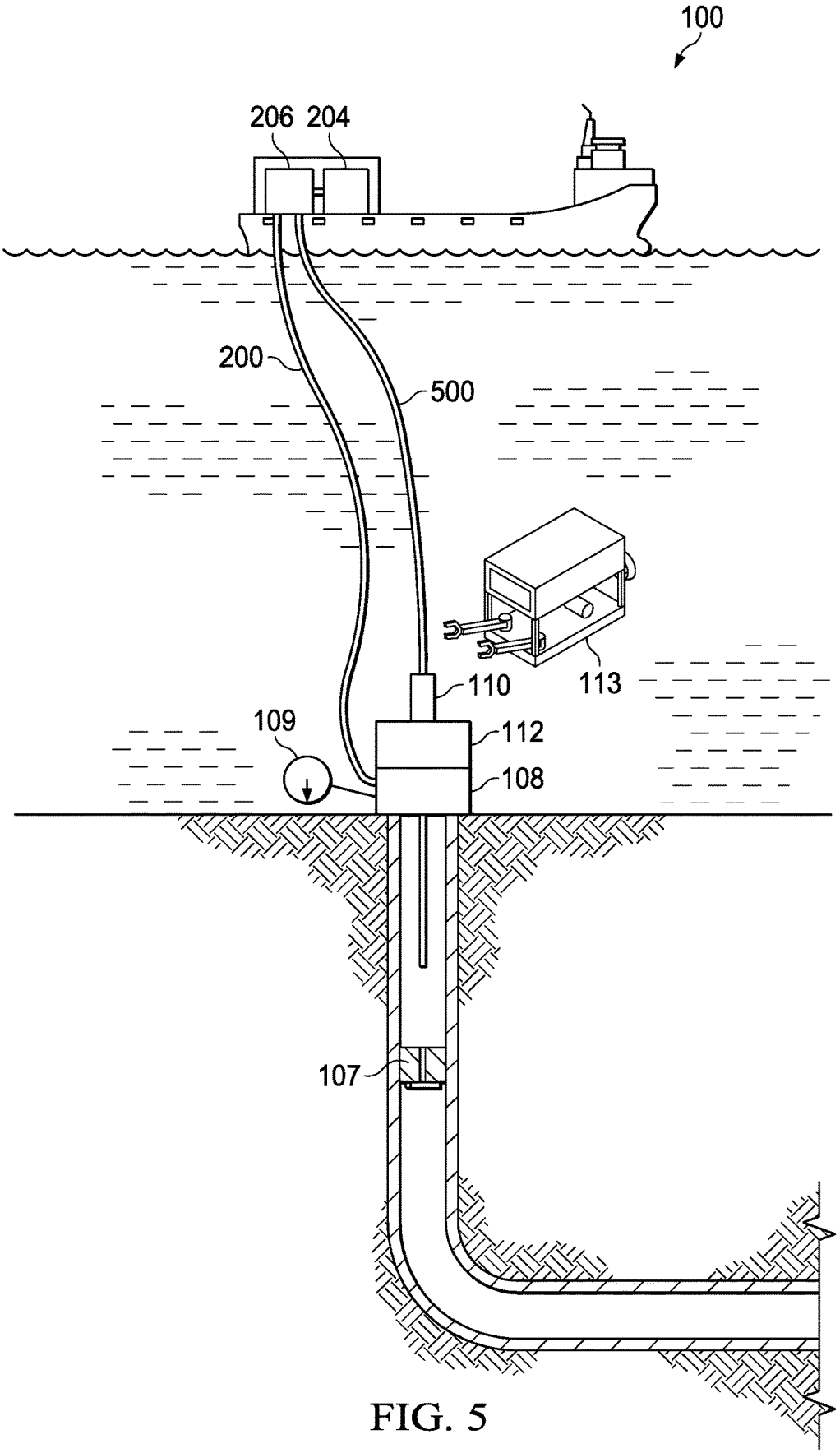
FIG. 5 illustrates the system for gravity feeding the CT during a fifth stage, in accordance with particular examples of the present disclosure.

FIG. 5 illustrates the system 100 for gravity feeding CT into the wellbore 102 during a fifth stage, in accordance with examples of the present disclosure. CT 500 may be gravity fed into the wellbore 102 from the intervention vessel 114 via an open CT stripper 110, the PCE 112, and the wellhead 108. In some examples, the CT 500 may be fed into the wellbore 102 until reaching the safety valve 107. In some examples, the CT stripper 110 may be closed before opening and passing through the wellhead 108, via hydraulic means such as in a subsea stripper, to provide a seal around the CT 500 and isolate a section between the wellhead 108 and the CT stripper 110 before opening the wellhead 108.

In some examples, the ROV 113 may position the CT 500 for placement into the wellbore 102. The wellhead pressure remains at the reduced level to allow gravity feeding of the CT 500, as indicated by the pressure gauge 109. The safety valve 107 remains closed.

Figure 6:
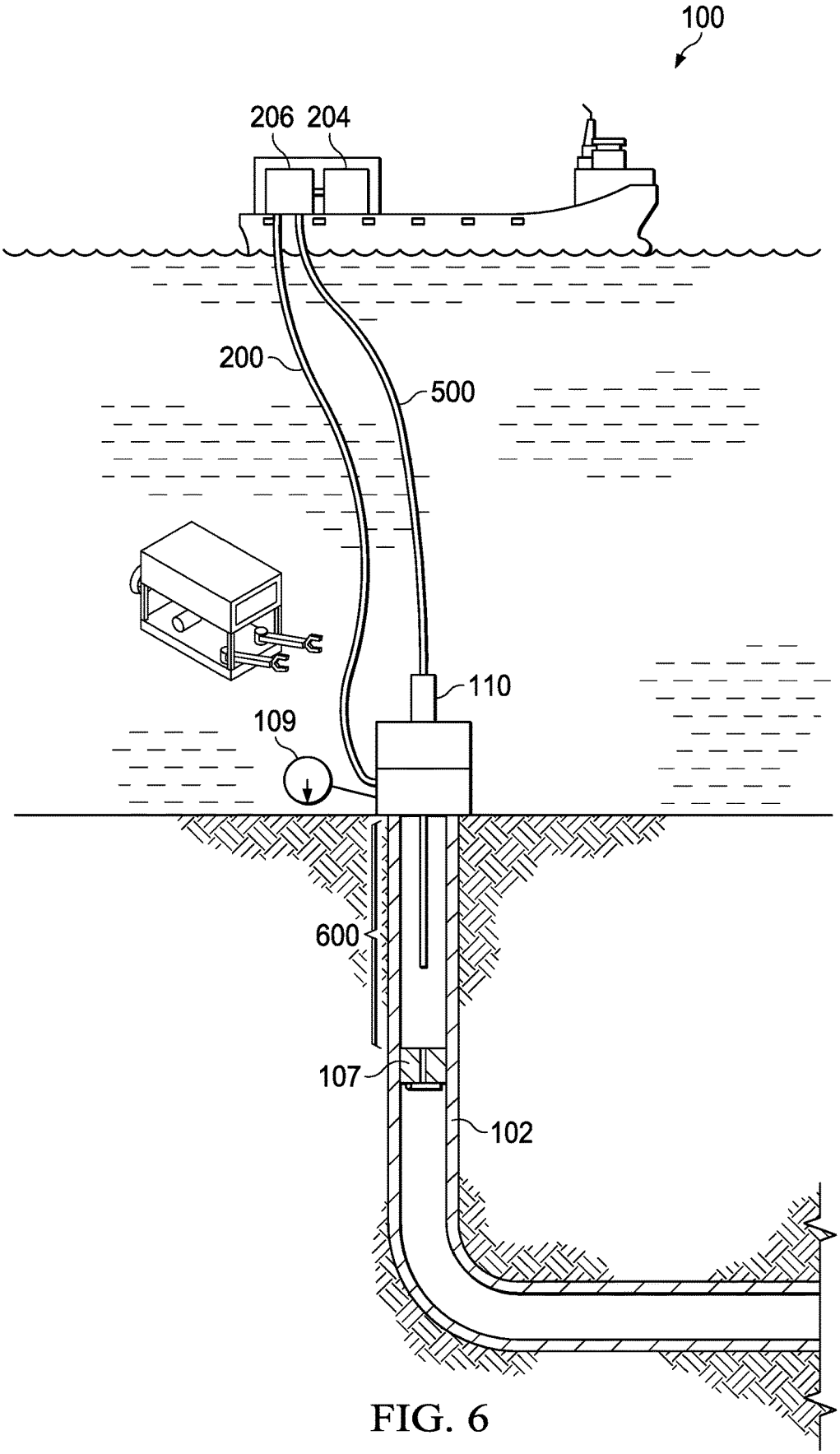
FIG. 6 illustrates the system for gravity feeding the CT during a sixth stage, in accordance with particular examples of the present disclosure.

FIG. 6 illustrates the system 100 for gravity feeding the CT 500 into the wellbore 102 during a sixth stage, in accordance with examples of the present disclosure. The CT stripper 110 may close, for example, via hydraulic means such as in a subsea stripper, to provide a seal around the CT 500 and isolate a section 600 of the wellbore 102 that extends between the CT stripper 110 and the closed safety valve 107. The wellhead pressure remains at the reduced level, as indicated by the pressure gauge 109.

Figure 7:
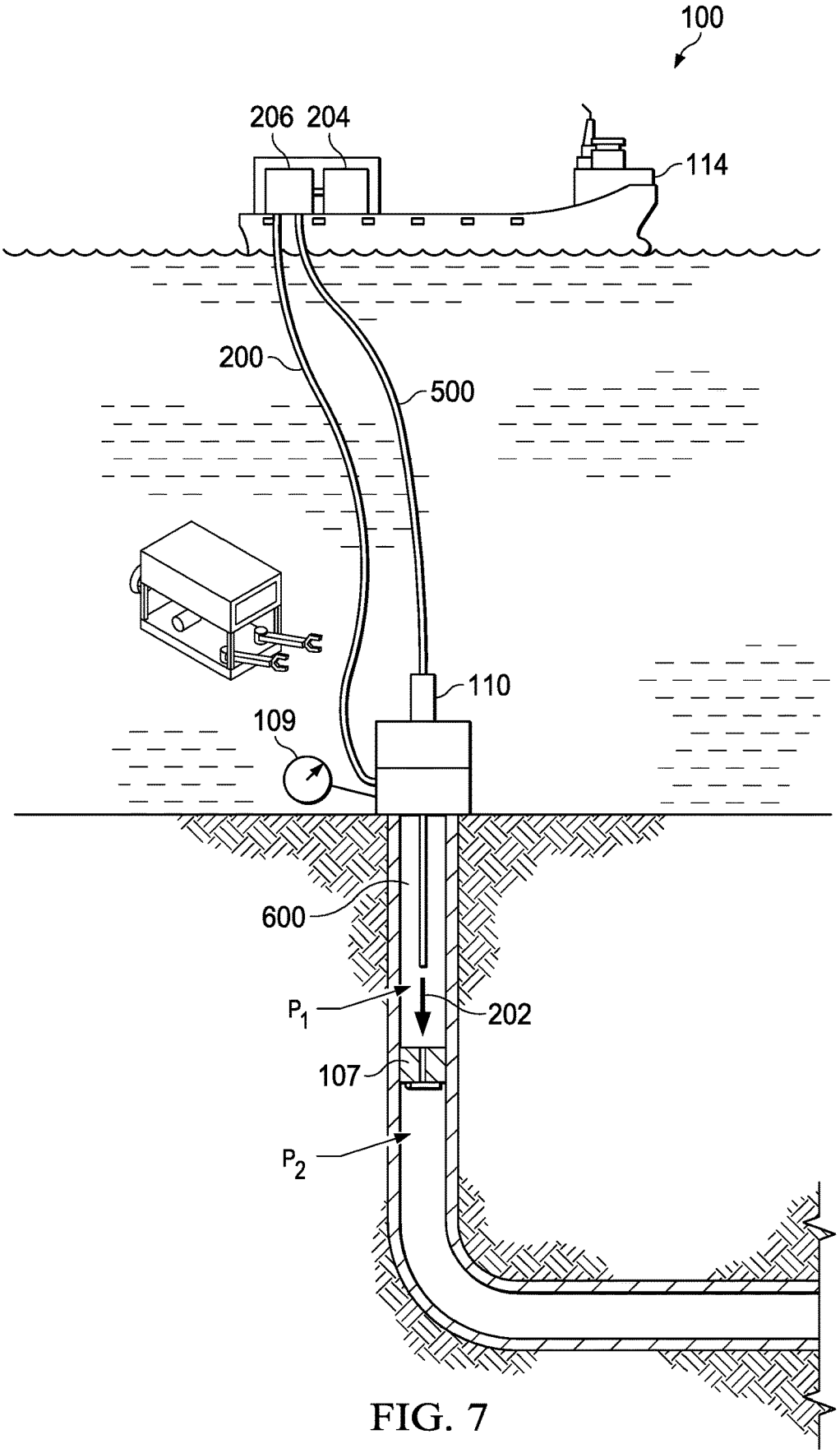
FIG. 7 illustrates the system for gravity feeding the CT during a seventh stage, in accordance with particular examples of the present disclosure.

FIG. 7 illustrates the system 100 for gravity feeding the CT 500 into the wellbore 102 during a seventh stage, in accordance with examples of the present disclosure. The CT stripper 110 remains closed, and the fluid 202 may be pumped via the CT 500 into the section 600 until pressures (e.g., $P_1$ and $P_2$) on both up-hole and downhole sides of the safety valve 107 are equal or about equal (e.g., a reduction in a pressure differential across the safety valve 107). The pump 206 may move the fluid 202 into the section 600 from the source 204 or another location. The increased wellhead pressure is indicated by the pressure gauge 109.

Figure 8:
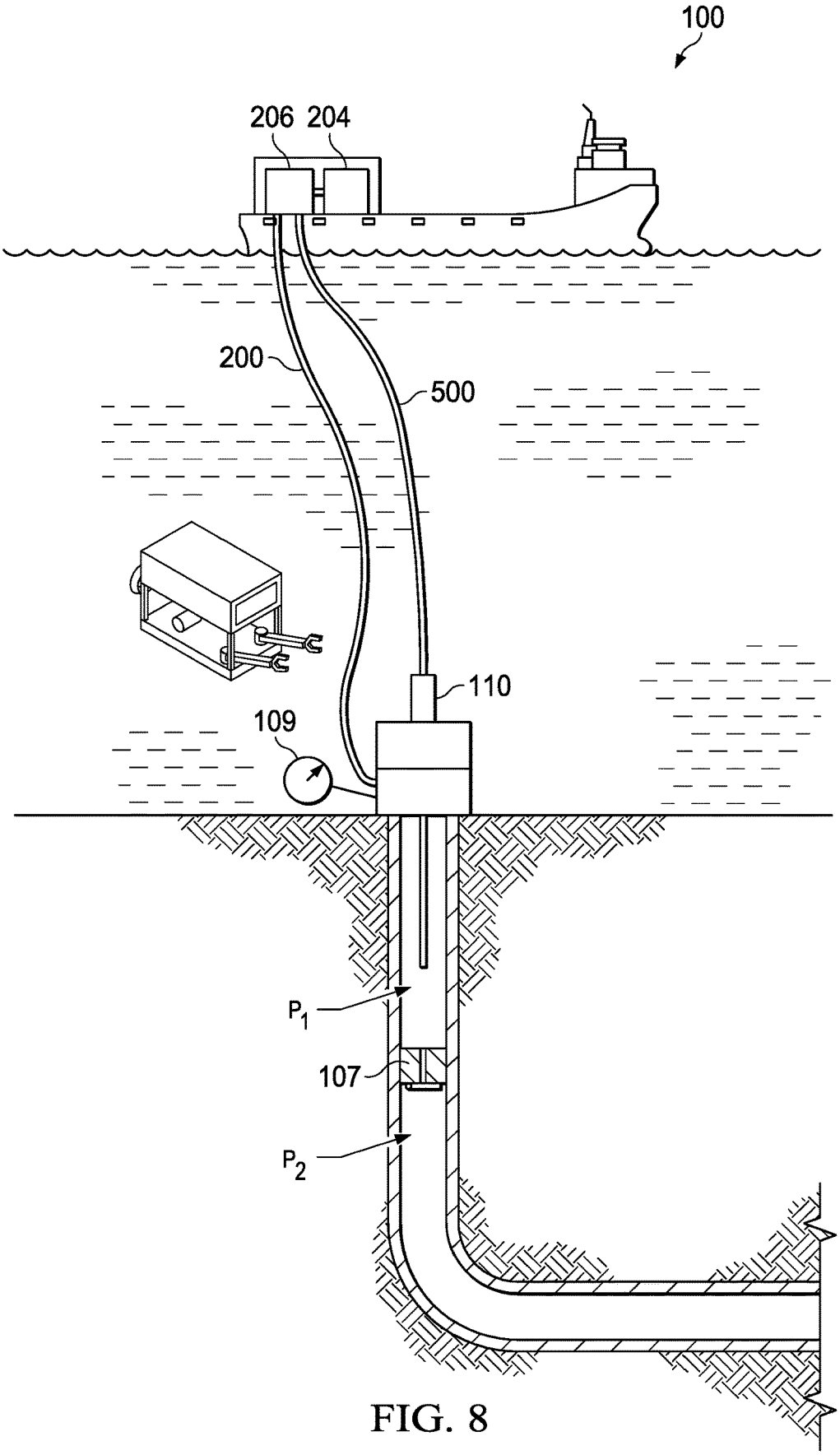
FIG. 8 illustrates the system for gravity feeding the CT during an eighth stage, in accordance with particular examples of the present disclosure.

FIG. 8 illustrates the system 100 for gravity feeding the CT 500 into the wellbore 102 during an eighth stage, in accordance with examples of the present disclosure. The CT stripper 110 may remain closed and seal around the CT 500, and the safety valve 107 may open via hydraulic or electric means. $P_1$ and $P_2$ may be equalized (or about equalized) and the pressure remains, as indicated by the pressure gauge 109.

Figure 9:
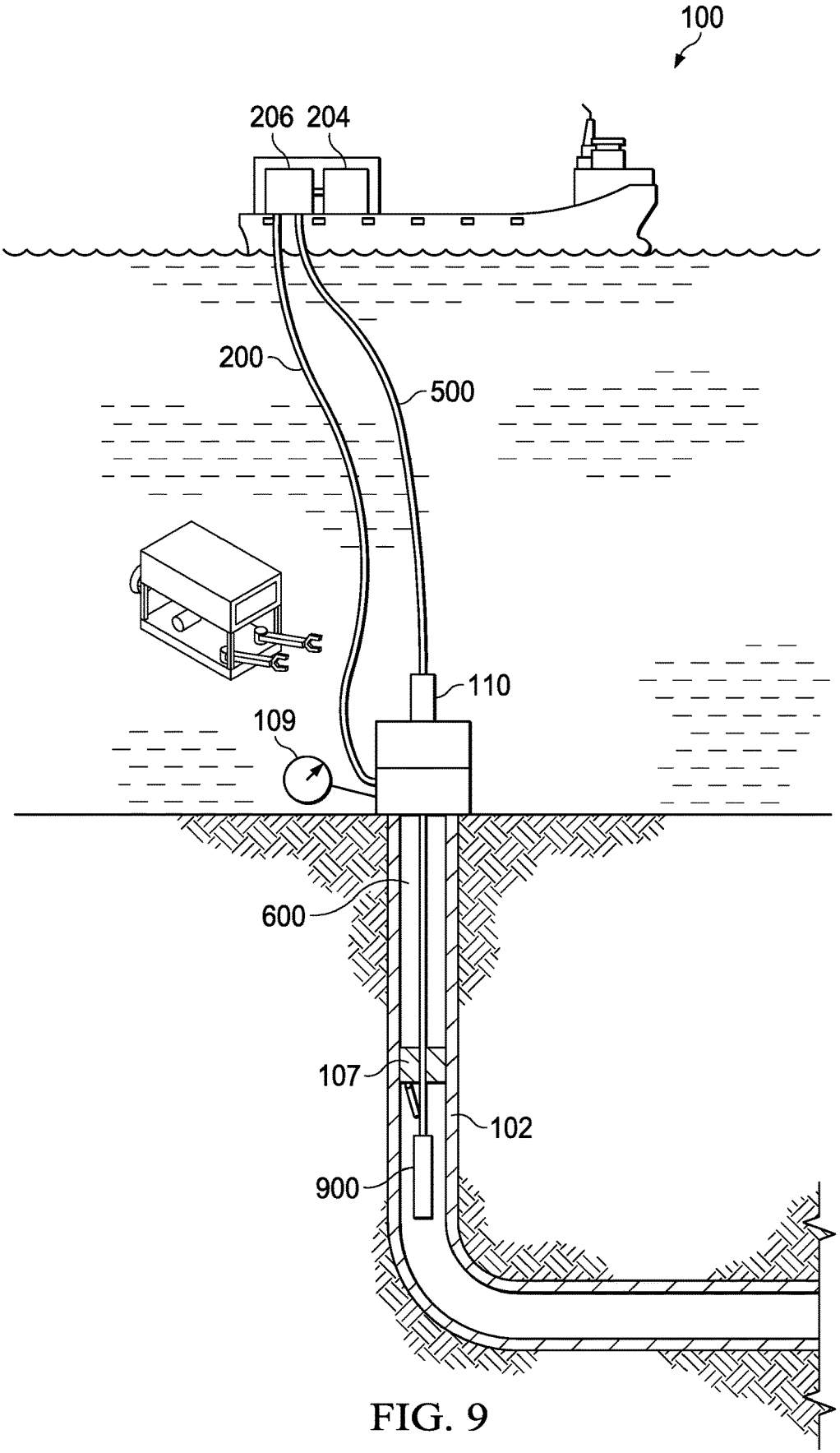
FIG. 9 illustrates the system for gravity feeding the CT during a ninth stage, in accordance with particular examples of the present disclosure.

FIG. 9 illustrates the system 100 for gravity feeding the CT 500 into the wellbore 102 during a ninth stage, in accordance with examples of the present disclosure. The CT 500 may continue to be gravity fed into the wellbore 102 to pass through the open safety valve 107. The CT stripper 110 remains closed to seal the wellbore 102 and maintain pressure, as indicated by the pressure gauge 109. When pulling the CT 500 out of the wellbore 102, the safety valve 107 may be utilized as a lubricator.

For example, once a BHA 900 (e.g., disposed on the CT 500) passes the safety valve 107 on the way out, fluid may be pumped through the downline 200 to force any reservoir fluid into the section 600. Then, the safety valve 107 may be closed and pressure may bleed through the downline 200. Then, the CT 500 may be pulled from the wellbore 102, and when the CT 500 passes the wellhead 108, the wellhead 108 may be closed and the safety valve 107 opens again. Similar variations as for running in the well may be considered when pulling out of the well.

Figure 10:
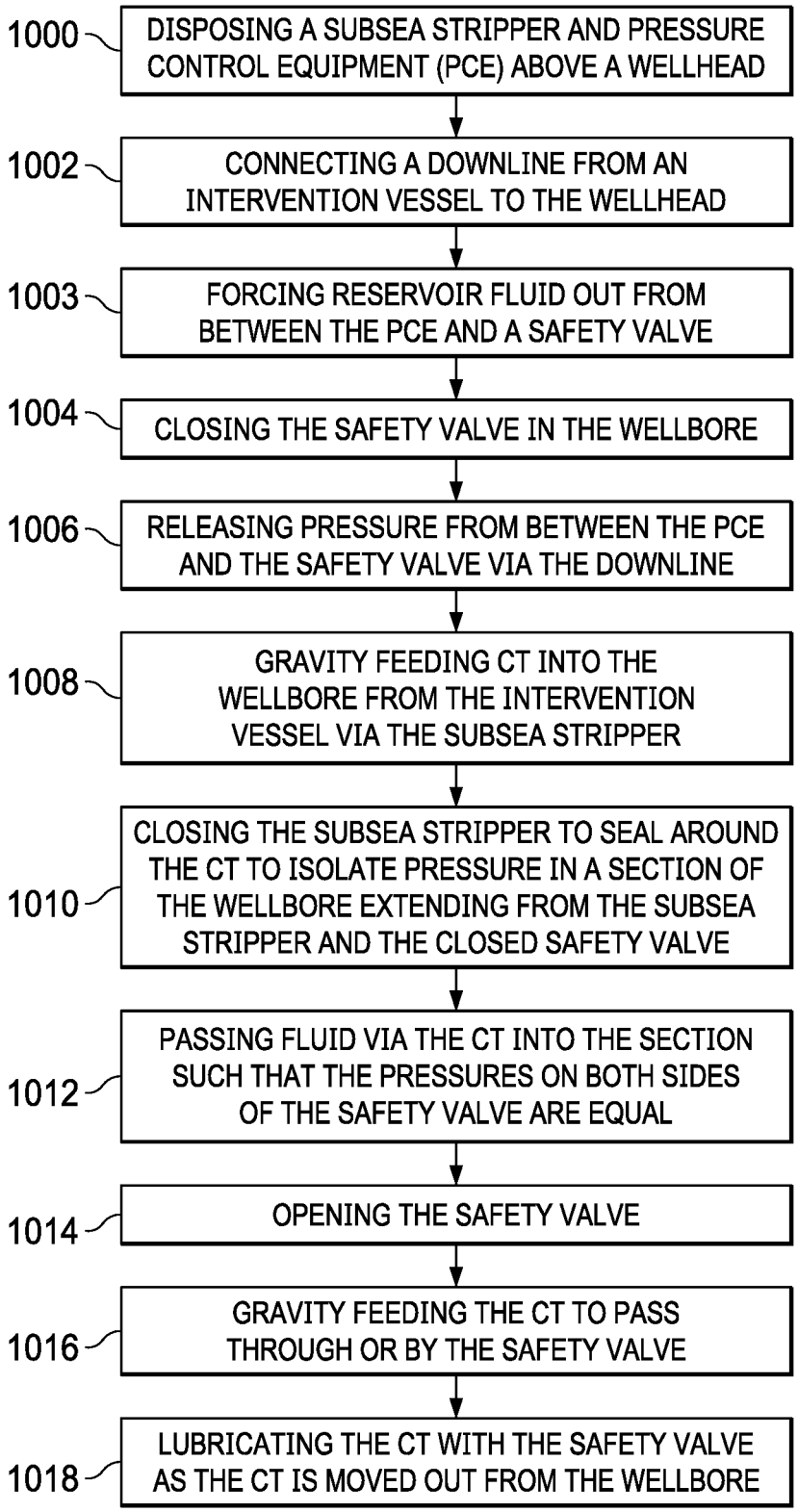
FIG. 10 illustrates an operative sequence for running CT into a wellbore, in accordance with particular examples of the present disclosure.

FIG. 10 illustrates an operative sequence for running CT into a wellbore, in accordance with examples of the present disclosure. At step 1000, a CT stripper and PCE may be disposed (e.g., installed) above the wellhead, as shown on FIG. 1, for example. The wellhead, the PCE and then the CT stripper may provide a seal for maintaining pressure (e.g., a subsea stripper) below the CT stripper. The PCE may include blow-out preventers, for example. The CT stripper and the PCE may be installed on the seafloor via a remotely operated vehicle that may be deployed from intervention vessel 114.

At step 1002, a downline line (e.g., kill/return line) extending from an intervention vessel may be connected (e.g., via the ROV) to the wellhead, and fluid may be injected into the wellbore to replace/displace any fluid/hydrocarbons between the safety valve and the wellhead, as shown on FIG. 2, for example. The downline 200 may connect to a kill/flow line or any subsea connection.

The fluid 202 may be moved into the wellbore 102 from a fluid source 204 via a pump 206. Non-limiting examples of the fluid 202 may include brine, water, or gas (e.g., nitrogen). Injection of the fluid may cease when a sufficient amount of fluid is injected to force a volume of reservoir fluid(s) out of the section between the safety valve 107 and the wellhead 108. For example, a total volume of the reservoir fluid may be urged downhole below the safety valve 107. In some examples, it may be desired to displace all or substantially all of the reservoir fluid.

At step 1003, reservoir fluid may be forced/chased out from between the PCE and the safety valve via the line.

At step 1004, a safety valve (e.g., a TRSV) in the wellbore may be closed, as shown on FIG. 3, for example. The wellhead pressure may remain at a sufficient level to prevent gravity feeding of CT.

At step 1006, the pressure between the PCE and the safety valve may be bled. For example, the pressure may be bled through the downline (e.g., kill/return line) back to the intervention vessel or another location, until the wellhead pressure is reduced.

At step 1008, the CT may be gravity fed into the wellbore from the intervention vessel via an open CT stripper, the PCE, and the wellhead, as shown on FIG. 5. In some examples, the CT stripper may be closed before opening and passing through the wellhead. In some examples, the CT may be fed into the wellbore until reaching the safety valve.

In some examples, the ROV may position the CT for placement into the wellbore. The wellhead pressure remains at the reduced level to allow gravity feeding of the CT. The safety valve may remain closed.

At step 1010, the CT stripper may close, for example, via hydraulic means such as in a subsea stripper, to provide a seal around the CT and isolate a section of the wellbore that extends between the CT stripper and the closed safety valve, as shown on FIG. 6. The wellhead pressure may remain at the reduced level.

At step 1012, the CT stripper remains closed, and fluid may be passed (e.g., pumped) via the CT into the section that extends between the CT stripper and the closed safety valve until pressures (e.g., $P_1$ and $P_2$) on both up-hole and down-hole sides of the safety valve are equal, as shown on FIG. 7, for example. A pump may move the fluid into the section from a fluid source or another location.

At step 1014, the stripper remains closed, and the safety valve may open via hydraulic means such as in TRSVs. $P_1$ and $P_2$ are equalized, as previously noted, and the pressure remains elevated, as shown on FIG. 8, for example.

At step 1016, the CT may continue to be gravity fed into the wellbore to pass through the open safety valve. The CT stripper remains closed to seal the wellbore and maintain pressure, as shown on FIG. 9, for example.

At step 1018, when pulling the CT out of the wellbore, the safety valve may be utilized as a lubricator. The configuration of the system for removal of the CT may be represented by FIG. 9, for example. For example, once a BHA (e.g., disposed on the CT) passes the safety valve on the way out, fluid may be pumped through the downline to force any reservoir fluid into the section 600 (e.g., shown on FIG. 9). Then, the safety valve may be closed, and pressure may bleed through the downline. Then, the CT may be pulled from the wellbore, and when the CT passes the wellhead, the wellhead may be closed and the safety valve opens again. Similar variations as for running in the well may be considered when pulling out of the well.

Accordingly, the systems and methods of the present disclosure may allow for gravity feeding of CT into live wells during interventions. The systems and methods may include any of the various features disclosed herein, including one or more of the following statements.

Statement 1. A method for gravity feeding coiled tubing (CT) into a wellbore having a wellhead, wherein a line is in fluid communication with the wellhead, wherein a CT stripper and pressure control equipment (PCE) are disposed above the wellhead, and wherein a safety valve is disposed in the wellbore below the wellhead, the method comprising: injecting a fluid through the line and into the wellbore to displace reservoir fluid positioned above the safety valve such that at least a portion of the reservoir fluid is forced below the safety valve; closing the safety valve; releasing pressure from the space between the PCE and the safety valve via the line; gravity feeding the CT into the wellbore; isolating pressure in the space between the PCE and the safety valve; reducing a pressure differential across the safety valve; opening the safety valve; and gravity feeding the CT past the safety valve.

Statement 2. The method of the statement 1, further comprising disposing a CT stripper and the PCE above the wellhead with a remotely operated vehicle.

Statement 3. The method of the statement 2, further comprising connecting the line from an intervention vessel to the wellhead.

Statement 4. The method of any of the preceding statements, further comprising displacing all of the reservoir fluid below the safety valve.

Statement 5. The method of any of the preceding statements, wherein the step of gravity feeding comprises passing the CT into the wellbore via a CT stripper and the PCE.

Statement 6. The method of any of the preceding statements, wherein the step of isolating the pressure between the PCE and the safety valve comprises closing the CT stripper.

Statement 7. The method of any of the preceding statements, wherein the step of closing the safety valve in the wellbore comprises closing a tubing-retrievable safety valve.

Statement 8. The method of any of the preceding statements, wherein the step of opening the safety valve in the wellbore comprises opening a tubing-retrievable safety valve.

Statement 9. The method of any of the preceding statements, wherein the step of releasing the pressure from between the PCE and the safety valve via the line comprises moving fluid to an intervention vessel.

Statement 10. The method of any of the preceding statements, further comprising lubricating the CT with the safety valve while removing the CT from the wellbore.

Statement 11. A system for gravity feeding coiled tubing (CT) into a wellbore, comprising: the CT; a line; a wellhead; a CT stripper and pressure control equipment (PCE) disposed above the wellhead, wherein the line is in fluid communication with the wellhead; a safety valve disposed in the wellbore below the wellhead; and a remotely operated vehicle operable to connect the line to the wellhead to release pressure from the wellbore.

Statement 12. The system of the statement 11, further comprising a safety valve disposed in the wellbore.

Statement 13. The system of the statement 11 or the statement 12, wherein the safety valve comprises a tubing-retrievable safety valve.

Statement 14. The system of any of the statements 11-13, wherein the safety valve is operable to lubricate the CT upon removal of the CT from the wellbore.

Statement 15. The system of any of the statements 11-14, wherein pressures on both sides of the safety valve are equal.

Statement 16. The system of any of the statements 11-15, wherein the CT stripper and the safety valve are operable to hold pressure therebetween.

Statement 17. The system of any of the statements 11-16, wherein the CT is operable to pressurize a space between the PCE and the safety valve.

Statement 18. The system of any of the statements 11-17, wherein the CT stripper and the safety valve are closed.

Statement 19. The system of any of the statements 11-18, wherein the CT stripper is closed to seal around the CT.

Statement 20. The system of any of the statements 11-19, further comprising an intervention vessel comprising the CT and the line, wherein the intervention vessel is operable to receive released pressure from the wellbore via the line.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for gravity feeding coiled tubing (CT) into a wellbore having a wellhead, wherein a line is in fluid communication with the wellhead, wherein a CT stripper and pressure control equipment (PCE) are disposed above the wellhead, and wherein a safety valve is disposed in the wellbore below the wellhead, the method comprising:

injecting a fluid through the line and into the wellbore to displace reservoir fluid positioned above the safety valve such that at least a portion of the reservoir fluid is forced below the safety valve;

closing the safety valve, wherein a pressure at the wellhead is at a level to prevent gravity feeding of the CT while the safety valve is closed;

releasing pressure from a space between the PCE and the safety valve via the line until the pressure at the wellhead is reduced to allow gravity feeding of the CT;

gravity feeding the CT into the wellbore;

closing the CT stripper via a subsea stripper to seal around the CT and isolate a section of the wellbore that extends between the CT stripper and the closed safety valve;

isolating pressure in the space between the PCE and the safety valve, wherein the pressure at the wellhead remains at a reduced level;

passing fluid via the CT into the section that extends between the CT stripper and the closed safety valve to reduce a pressure differential across the safety valve while the CT stripper remains closed;

opening the safety valve;

gravity feeding the CT past the safety valve while the CT stripper remains closed to seal the wellbore and maintain pressure;

pulling the CT out of the wellbore; and lubricating the CT in a section of tubing between the safety valve and the pressure control equipment.

2. The method of claim 1, further comprising disposing a CT stripper and the PCE above the wellhead with a remotely operated vehicle.

3. The method of claim 1, further comprising connecting the line from an intervention vessel to the wellhead.

4. The method of claim 1, further comprising displacing all of the reservoir fluid below the safety valve.

5. The method of claim 1, wherein the step of gravity feeding comprises passing the CT into the wellbore via a CT stripper and the PCE.

6. The method of claim 1, wherein the step of closing the safety valve in the wellbore comprises closing a tubing-retrievable safety valve.

7. The method of claim 6, wherein the step of opening the safety valve in the wellbore comprises opening a tubing-retrievable safety valve.

8. The method of claim 1, wherein the step of releasing the pressure from between the PCE and the safety valve via the line comprises moving fluid to an intervention vessel.

9. The method of claim 1, further comprising lubricating the CT with the safety valve while removing the CT from the wellbore.

10. A method for gravity feeding coiled tubing (CT) into a wellbore, the method comprising:

injecting a fluid into the wellbore to displace reservoir fluid positioned above a safety valve such that at least a portion of the reservoir fluid is forced below the safety valve;

closing the safety valve, wherein a pressure at a wellhead is at a level to prevent gravity feeding of the CT while the safety valve is closed;

releasing pressure from the wellbore until the pressure at the wellhead is reduced to allow gravity feeding of the CT;

gravity feeding the CT into the wellbore;

isolating pressure in the wellbore, wherein the pressure at the wellhead remains at a reduced level;

passing fluid into the wellbore to reduce a pressure differential across the safety valve;

opening the safety valve;

gravity feeding the CT past the safety valve;

lubricating the CT in a section of tubing between the safety valve and the pressure control equipment; and further comprising lubricating the CT with the safety valve while removing the CT from the wellbore, wherein the safety valve is disposed in the wellbore below the wellhead.

11. The method of claim 10, further comprising disposing a CT stripper and pressure control equipment (PCE) above the wellhead with a remotely operated vehicle.

12. The method of claim 10, further comprising connecting a line from an intervention vessel to the wellhead.

13. The method of claim 10, further comprising displacing all of the reservoir fluid below the safety valve.

14. The method of claim 10, wherein the step of gravity feeding comprises passing the CT into the wellbore via a CT stripper and PCE.

15. The method of claim 10, wherein the step of isolating the pressure comprises closing the CT stripper.

16. The method of claim 10, wherein the step of closing the safety valve in the wellbore comprises closing a tubing-retrievable safety valve.

17. The method of claim 16, wherein the step of opening the safety valve in the wellbore comprises opening a tubing-retrievable safety valve.

18. The method of claim 10, wherein the step of releasing the pressure from the wellbore comprises moving fluid to an intervention vessel.

* * * * *